United States Patent [19]

McCord, Sr.

[11] Patent Number: 4,800,793

[45] Date of Patent: Jan. 31, 1989

[54] COMPOUND MITER BOX

[75] Inventor: Kenneth L. McCord, Sr., Mobile, Ala.

[73] Assignee: Carolyn McCord, Mobile, Ala. ; a part interest

[21] Appl. No.: 140,582

[22] Filed: Jan. 4, 1988

[51] Int. Cl.[4] ..... B27B 5/20

[52] U.S. Cl. ..... 83/467 R; 83/471.3; 83/486.1; 83/767

[58] Field of Search ..... 83/471.3, 467, 468, 83/767, 486.1; 144/286 R

[56] References Cited

U.S. PATENT DOCUMENTS

| | | | |
|---|---|---|---|
| 1,332,714 | 3/1920 | D'Arey et al. | 83/767 |
| 3,483,901 | 12/1969 | Ray | 83/471.3 |
| 3,896,692 | 7/1975 | Stubbs | 83/471.3 |
| 4,576,076 | 3/1986 | Pyle | 83/471.3 |
| 4,694,720 | 9/1987 | Brickner, Jr. et al. | 83/471.3 |

*Primary Examiner*—Frank T. Yost

*Attorney, Agent, or Firm*—Keaty & Keaty

[57] ABSTRACT

A portable miter box for making miter cuts with a hand saw comprising an elongated work board supportable by legs at each of its ends. A swivel plate means positioned under the middle portion of the work board and adjustable for a limited horizontal movement in relation to said work board. Means for limiting longitudinal movement of a saw in relation to the swivel plate means. A saw guide assembly supported in parallel relationship above the work board and a front and back degree plate means attached, in opposing relationship to each other to the work board.

10 Claims, 3 Drawing Sheets

COMPOUND MITER BOX

BACKGROUND OF THE INVENTION

1. Field of the Invention

The present invention relates to devices for guiding an electrical handsaw at a proper angle for making cuts at selected angles, such as for example, miter joints, moldings from wood or plastic.

The apparatus in accordance with the present invention is especially beneficial in making compound cuts of molds and rafters which are produced with the help of an electrical circular saw.

In forming a miter joint, for example, two elements must be fastened together usually perpendicularly to each other with their ends cut at an angle. A conventional miter box is made in the form of a wooden or metal trough, the upright sides of which are provided with fixed or adjustable vertical slots. A saw, for example, hand saw is positioned within the slots and the work piece is placed on the bottom of the trough so that a cut at a suitable angle is made by the hand saw.

There are also known devices for guiding an electrical saw while creating a compound miter cut, one example of such devices is disclosed in U.S. Pat. No. 4,448,102 issued on May 15, 1984 for "Compound Miter Saw Stand".

The patent discloses a saw guide for making miter cuts on a work piece, the saw guide comprising a stand supporting a pair of horizontal plates at their respective end portions. A work piece travel path is defined by upright post assemblies at each side of the stand, while a track assembly and a saw cradle assembly overlies the work piece travel path, guiding opposing saws across the work piece travel path and forming pre-determined angular cuts on the end of a work piece which is positioned in the travel path.

While the saw stand in accordance with the '102 patent can be beneficial for creating miter cuts on a work piece in a factory environment, wherein roof and floor trusses are pre-fabricated and are subsequently transported to a building site. The miter saw stand in accordance with '102 patent is not portable, and can not be successfully used for creating complex cuts which require various angles of cuts such as compound cuts, molds, "cope lines" and the like. When creating such variety of angular cuts on a piece of wood, it is most beneficial to have such miter stand immediately available at the construction site, so that the necessary cuts of various angles can be made depending on the particular demand of the construction job, with a saw stand being easily transported to another construction site for performing other lumber cutting jobs.

SUMMARY OF THE INVENTION

The compound miter box in accordance with the present invention provides for a portable apparatus for forming miter cuts with a hand saw.

A work board supported by a leg at each of its ends has a front degree plate and a back degree plate unitarily attached to the work board.

A swivel plate extends transversely under a middle portion of the work board and is supported by legs independently from the work board. The swivel plate is pivotally connected to the work board for a limited horizontal pivoting movement. A saw guide assembly has a longitudinal dimension substantially equal to the longitudinal dimension of the swivel plate and is supported by the same legs which support the swivel plate, thereby forcing the saw guide assembly to rotate to the same angular position during pivoting movement as the swivel plate. An arcuate front edge of the front degree plate is provided with a plurality of notches dividing the front degree plate into number degree segments. A notch lock assembly is provided with a notch plunger which, under operational conditions, is urged into an engagement with a pre-selected notch by a tension spring, thus insuring a secure angular position of the swivel plate in relation to the work board.

A saw guide assembly is formed with a central longitudinal opening allowing passage of a saw blade to a workpiece which is positioned, during cutting operation, on the work board. The saw guide assembly is provided with a pair of parallel spaced-apart aligning guides laterally movable in relation to each other to accommodate different size saws.

A longitudinal slot formed in the front degree plate a distance from the arcuate edge receives a securing pin slidable within the slot to further secure position of the swivel plate, and therefore the saw guide, in relation to the work board.

It is therefore an object of the present invention to provide a compound miter box for forming various types and degrees miter cuts on a workpiece.

It is a further object of the present invention to provide a portable miter saw guide which can be easily transported from one job site to another.

These and other objects of the invention will be readily apparent to those skilled in the art from the foregoing description of the preferred embodiment.

DETAILED DESCRIPTION OF THE PREFERRED EMBODIMENT

Figure 1:
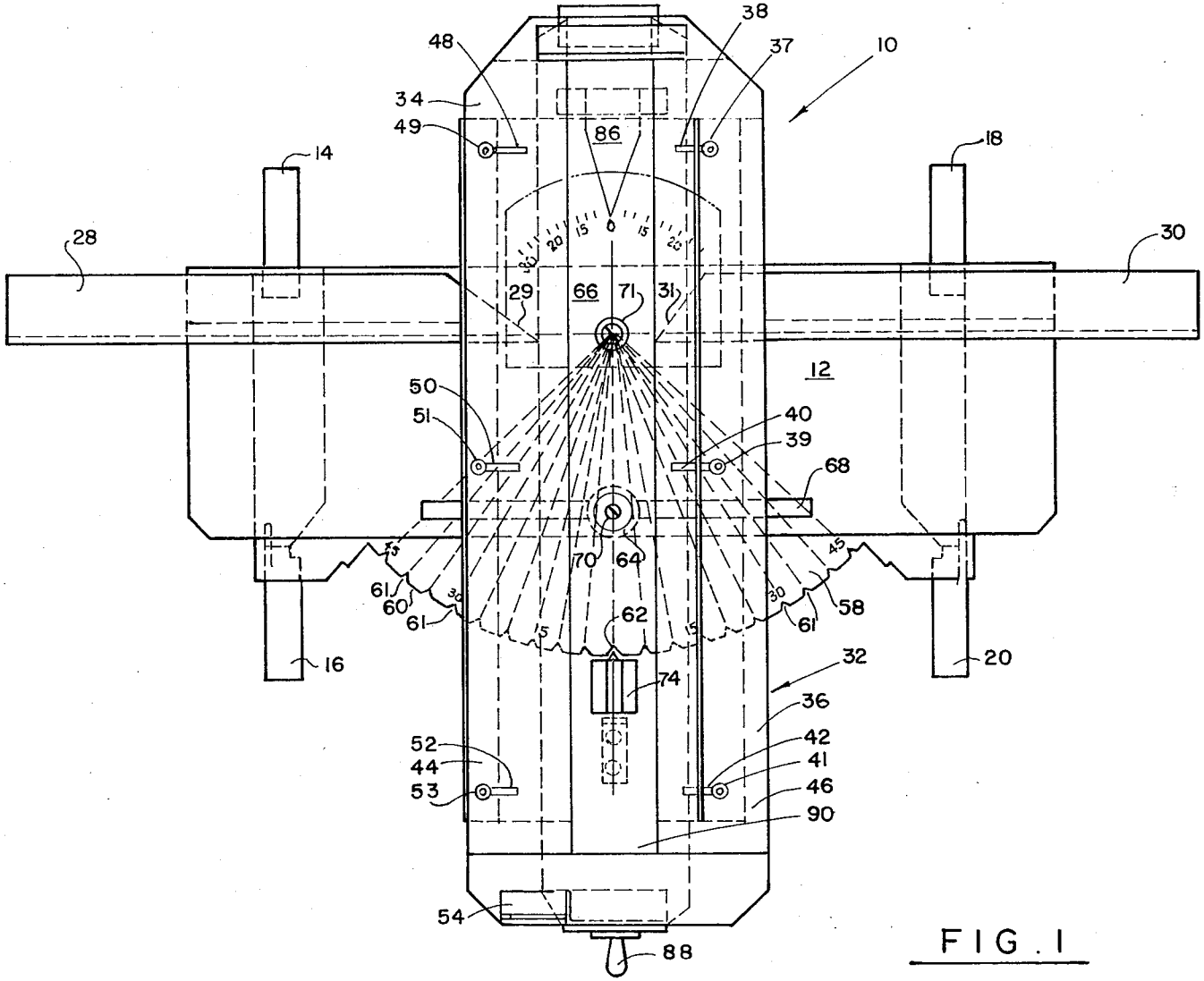
FIG. 1 is a top view of the apparatus in accordance with the present invention.
Figure 2:
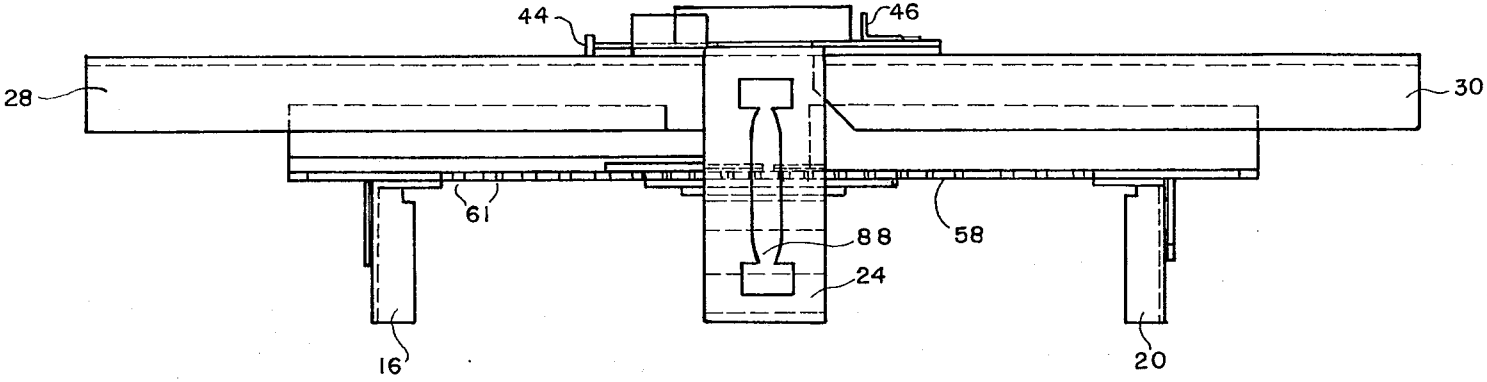
FIG. 2 is a front view thereof.
Figure 4:
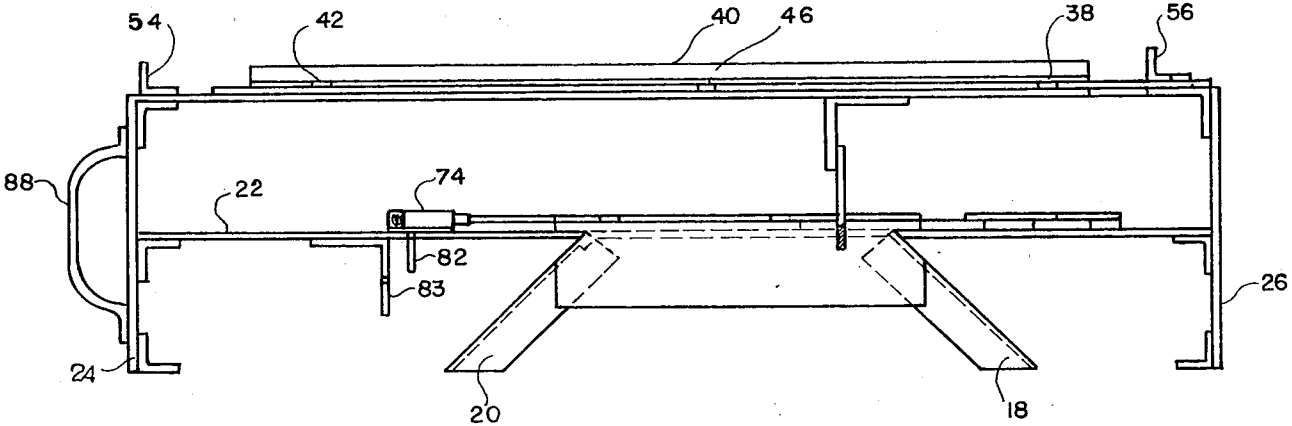
FIG. 4 is a side view thereof.
Figure 5:
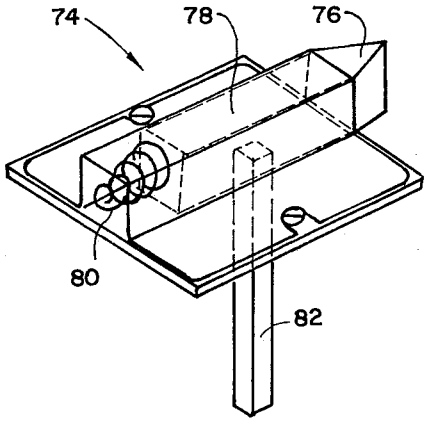
FIG. 5 is an elevational view showing in detail a notch lock assembly of the apparatus of the present invention.

Reference will now be made to the drawings, wherein numeral 10 designates the compound miter box in accordance with the present invention. The apparatus 10 comprises a work board 12 of a substantially rectangular configuration supported on each of its ends by a pair of legs 14, 16, 18 and 20. The work board 12 is attached to the legs 14–20 by for example, suitable brackets and bolts, or by other suitable attaching means affording fixed attachment of the work board 12 to the legs 14–20.

A swivel plate 22 is transversely positioned in relation to a longitudinal axis of the work board 12, with longitudinal dimensions of the swivel plate 22 exceeding the width of the work board 12. The ends of the swivel plate 22 are supported by respective legs 24 and 26, in such a manner that a horizontal plane on which the swivel plate 22 is positioned is in a parallel, slightly lower level than a horizontal plane on which the work board 12 is placed.

Extending upwardly in relation to the upper surface of work board 12 is a pair of elongated back rests 28 and 30 the inner ends 29 and 31 of which terminate adjacent a middle section of the work board 12.

Mounted transversely in relation to the back rest means 28 and 30 is a saw guide assembly 32 which is mounted above the back rest means 28 and 30 on a plane substantially parallel to the top surface of the work board 12. The ends of the saw guide assembly 32 are supported by legs 24 and 26 in vertical co-alignment with the ends of the swivel plate 22, thus making a unitary connection between swivel plate 22 and assembly 32. The saw guide assembly has a substantially rectangular form with elongated sides of the rectangle formed by a pair of opposing first saw guide plate 34 and a second saw guide plate 36 secured in a substantially parallel, co-planar relationship to each other. The saw guide plate 36 is provided with a number of elongated slots (best seen in FIGS. 1–4), the slots being designated by numerals 38, 40 and 42. The slots 38, 40 and 42 are made perpendicularly to a longitudinal axis of the saw guide plate 36 and have a width size for receiving a securing pin therethrough, as will be addressed in more detail hereinafter.

Selectively, adjustably secured on top of the saw guide plate 36 is an elongated aligning guide 46 which is adapted for sliding on top of the saw guide assembly 36 in a direction perpendicular to its longitudinal axis. The sliding motion is accomplished through the use of a number of securing pins 37, 39 and 41 passing through spaced-apart openings formed in the aligning guide 46 which are co-aligned with the slots 38, 40 and 42 formed in the saw guide plate 36. The planar movement of the aligning guide 46 is limited by the length of the slots 38–40, while the necessary position of the aligning guide 46 can be selected within the limits of the slots through the use of the securing pins 37, 39 and 41, or a similar securing means, passing first through the openings made in the aligning guide 46 and then through the slots 38–40 and 42, to be secured in their preselected position through the use of, for example, a wing nut threadably attached to each securing pin under the bottom surface of the saw guide plate 36.

The saw guide plate 34 carries an elongated aligning guide 44 mounted in an adjustably selectively secured relationship to the saw guide plate 34.

Lateral position of the aligning guide 44 can be adjusted through the use of adjusting slots 48, 50 and 52 in the guide 44 and corresponding openings in the guide plate 34 through which securing means, such as pins 49, 51 and 53 or the like, are passed and the securing nuts (not shown) are threadably attached to the securing pins under the bottom surface of the aligning guide 44. Alternatively, a number of brackets can be utilized for securing the aligning guide 44 to the guide plate 34. In this case, the brackets will be formed with slots for receiving the securing pins.

Through the use of the adjustable slots, the lateral distance between the aligning guides 44 and 46 can be easily varied depending on the particular size saw with which the work is performed on a work piece.

The aligning guides 44 and 46 are each formed by an L-shaped plate, the vertical portion of which extends above the top surface of the saw guide plates 34 and 36, respectively.

While the vertical portions of the L-shaped aligning guides 44 and 46 form lateral limits of movement for an electrical saw, the transverse longitudinal movement of the saw is limited by a front saw stop 54 and a back saw stop 56 (best seen in FIG. 4) which are fixedly attached at the ends of the saw guide assembly 32. At least a portion of each of the saw stops 54 and 56 extends perpendicularly upwardly in relation to the top surface of the assembly 32, thus creating an effective means for limiting longitudinal movement of an electrical saw in relation to the swivel plate 22.

Forming part of the work board 12 is a front degree plate 58 which is formed by a curved front portion of the work board 12. The curved end 60 is provided with a plurality of notches 61, dividing the front degree plate 58 into a plurality of degree segments, for example, 5° for each segment, so that a zero degree is designated by the central notch 62 coaligned with an opening 64 made in the work board 12 at a line coinciding with an imaginary line connecting the inner ends of the vertical portions of back rests 28 and 30.

Figure 3:
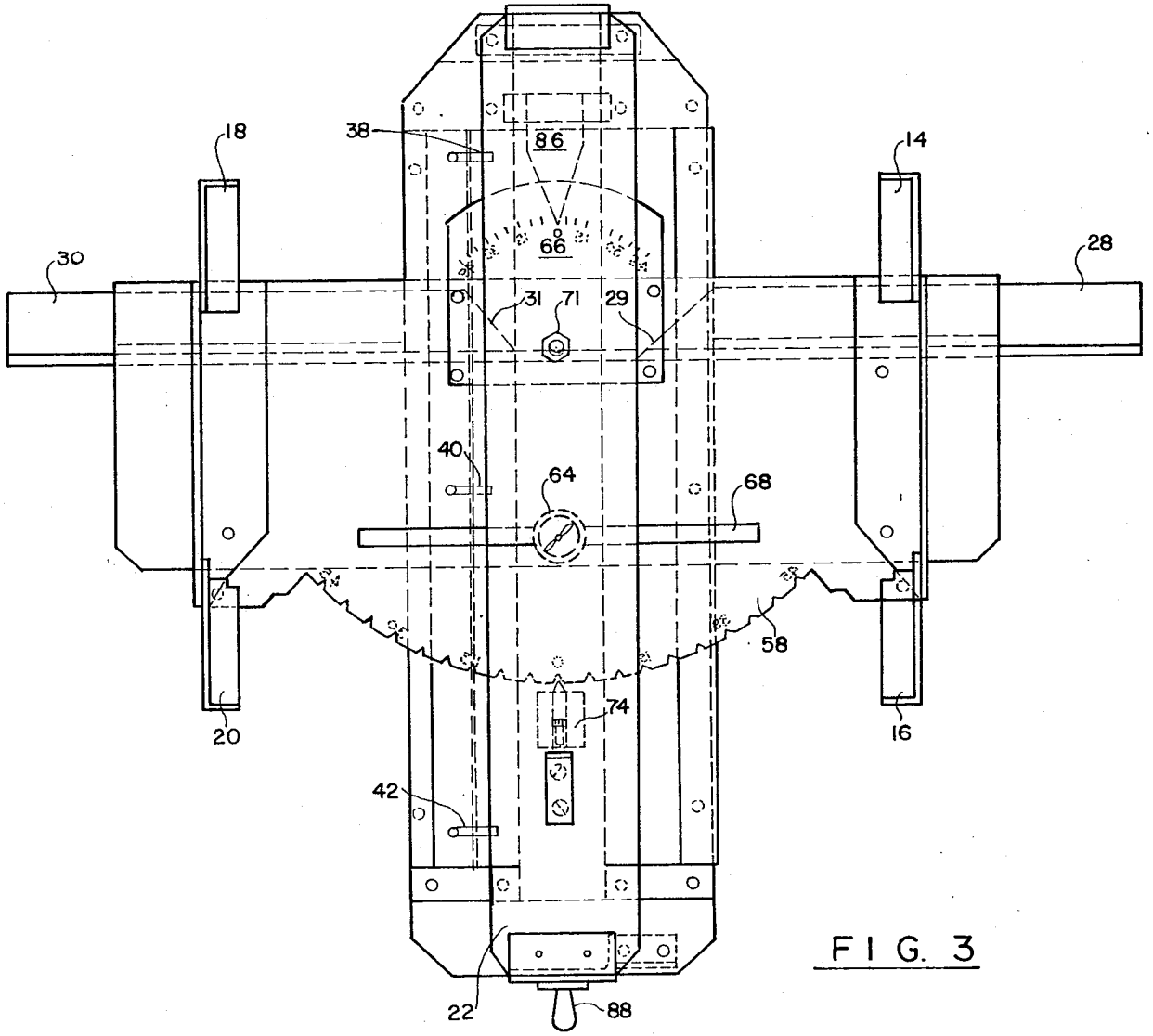
FIG. 3 is a bottom view of the apparatus of the present invention.

In the embodiment shown in FIGS. 1 and 3, the front degree plate covers 45° in each direction of the curve starting from the notch 62, so that a work piece can be positioned at any angle in relation to the back rest 28 and 30 while the work is being performed and an angular cut is made.

The work board 12 further comprises a back degree plate 66 positioned in opposing relationship to the front degree plate 58 and also calibrated into 5° segments with a "0°" coaligned with a "0" calibrated notch 62 of the front degree plate 58.

A longitudinal swivel guide slot 68 extends substantially along the length of the front degree plate 58, at a distance from the curved end 60 and is adapted to receive a securing pin 70 therein. A nut securing position of the pin 70 within the slot 68, at any of the calibrated segments of the front degree plate 58, is threadably attached to the pin 70 on the under the bottom side of the front degree plate 58.

Another securing pin 71 is engaged within co-aligned openings formed in the work board 12 and swivel plate 22.

The pin 71 serves as a pivot point for the swivel plate 22 when various angles must be established between the saw guide assembly 32 and the work board 12. When the swivel plate 22 is rotated about the pin 71, the pin 70 slides within the confines of the slot 68, until the preselected angle is reached. Then the nut of the pin 70 is tightened, ensuring that if an excessive force is applied to the pin 71 during operation of the device, the pin 71 does not break.

In order to further retain position at the preselected angle of the swivel plate 22 in relation to the front degree plate 58, a notch lock assembly 74 is securedly attached to the swivel plate 22. A notch plunger 76, which forms a part of the notch lock assembly 74 is mounted in sliding relationship within a sleeve 78, with the tip of the notch plunger 76 (having a triangular cross section in the embodiment shown in FIGS. 1–5) extending outside of the sleeve 78 and engaging within a notch of the front degree plate 58. The sleeve 78 has closed sides, one open end, through which the plunger 76 extends and a closed end. A tension spring 80 urges the plunger 76 away from the closed end of the sleeve 78, so that under normal operating conditions, the tip of the notch plunger 76 is engaged within a notch of the front degree plate 58.

When position of the swivel plate 22 in relation to the work board 12 is changed, the tension of the spring 80 is overridden by a pull handle 82 which slides in the slot 84 formed in the swivel plate 22 to allow a limited longitudinal movement of the notch plunger handle 82 within the slot. The handle being fixedly attached to the plunger 76, forces the plunger to retrieve within the sleeve 78, thus releasing it from its engagement within the notch and allowing a swivel rotation of the swivel plate 22 in relation to the work board 12. A plunger handle rest 83 (shown in FIG. 4) limits movement of the handle 82, also making it convenient to pull the handle by allowing an operator's thumb to receive a fixed point against which a pulling force can be exerted.

A back degree plate indicator 86 is securedly attached to the rear portion of the swivel plate 22, with one end of the indicator 86 having a triangular plan view. A portion of the indicator 86 extends over the back degree plate 66, pointing to the degree selected for performing a cut on a piece of lumber. As will be appreciated, the indicator 86 rotates, to a limited degree, along with the swivel plate 22, to which it is fixedly attached, thus insuring further alignment of the electrical saw in relation to the work board 12 and, thereby, to the work piece.

In order to assist in transporting the compound miter box 10 to a location wherein the work is to be performed, a handle 88 is fixedly attached, by means of, for example, suitable brackets and bolts to the front side of the assembly leg 24.

In operation, the miter box 10 is transported to construction site, or a similar location, and positioned at a suitable elevated surface, for example, a work table. A preselected angular cut is insured by selecting the degree segment on the front degree plate 58, and thus angular position of the swivel plate 22 in relation to the work board 12. The fixed relationship of the plate 22 and the work board 12 is retained by the securing pin 70 within the slot 68 and is further ensured by engaging the plunger 76 with a suitable degree notch of the curved end 60 of the front degree plate 58. The necessary size electrical saw is thereafter selected and, depending on the size of the saw, the aligning guides 44 and 46 are moved laterally in relation to each other, so that the vertical portions of the aligning guides 44 and 46 are spaced to a predetermined distance. The electrical saw is then secured on top of the guide assembly 32 in such a manner that the cutting blade of the saw extends through an opening 90 formed between the saw guide plates 34 and 36. A work piece is secured in the manner known to those skilled in the art on the work board 12, with one side of the work piece resting against the vertical portions of the back rests 28 and 30.

The operator then energizes the saw and manually reciprocates the saw along the longitudinal slot 90 formed by the saw guide plates 34 and 36.

In this manner, the necessary degree compound cut can be formed utilizing the miter box 10 in accordance with the present invention. After the work has been completed, the saw is de-energized, removed from its resting position on top of the saw guide plates 34 and 36 and the miter box 10 can be transported into another location to perform the job on site.

It is apparent that minor modifications can be easily made in the preferred embodiment shown and described herein without departing from the spirit and scope of the present invention. I, therefore, pray that my rights to the invention be limited only by the scope of the following claims.

I claim:

1. A compound miter box apparatus for forming miter cuts with a hand saw, comprising:

an elongated work board supportable by a leg at each of its ends;

a swivel plate means transversely positioned under a middle portion of the work board, said swivel plate supportable by legs independently from said work board and adjustable for a limited horizontal pivotal movement in relation to said work board;

a saw guide assembly supportable by the swivel plate supporting legs in a parallel relationship above the work board;

means for limiting longitudinal movement of a saw in relation to the swivel plate means;

a front degree plate means securedly attached to the work board; and a back degree plate means securedly attached to the work board opposite said front degree plate means.

2. The apparatus of claim 1, further comprising means for selectively securing an angular position of the swivel plate means in relation to the work board, said means comprising a notch lock assembly provided with a notch plunger urged by a tension spring means into engagement with a selected notch formed in the front degree plate means.

3. The apparatus of claim 2, wherein said notch lock assembly further comprises means for overriding tension of the spring means and allowing disengagement of the notch plunger from said notch formed in the front degree plate means.

4. The apparatus of claim 3, wherein tension spring overriding means comprises a pull handle adapted for sliding movement within a slot formed in the swivel plate means.

5. The apparatus of claim 1, wherein the saw guide assembly is provided with a pair of substantially parallel spaced-apart aligning guides laterally movable in relation to each other.

6. The apparatus of claim 5, wherein said saw guide assembly comprises a pair of elongated saw guide plates, and lateral movement of the aligning guides is limited by extent of at least one slot, each formed in the saw guide plate perpendicular to its longitudinal axis.

7. The apparatus of claim 1, further comprising means for facilitating a secured position of the swivel plate means in relation to the work board comprises a securing pin adapted for limited movement within a swivel guide slot formed in the front degree plate means.

8. The apparatus of claim 1, wherein said front degree plate means and said back degree plate means are unitarily attached to said work board.

9. The apparatus of claim 1, wherein the swivel plate means is provided with a back degree plate means indicator fixedly attached to the swivel plate means.

10. The apparatus of claim 1, wherein the work board is provided with a pair of back rests for supporting a workpiece in a pre-determined fixed position on the work board.

* * * * *